United States Patent [19]

Otobe

[11] Patent Number: 4,751,909

[45] Date of Patent: Jun. 21, 1988

[54] FUEL SUPPLY CONTROL METHOD FOR INTERNAL COMBUSTION ENGINES AT OPERATION IN A LOW SPEED REGION

[75] Inventor: Yutaka Otobe, Shiki, Japan

[73] Assignee: Honda Giken Kogyo Kabushiki Kaisha, Tokyo, Japan

[21] Appl. No.: 52,132

[22] Filed: May 18, 1987

Related U.S. Application Data

[63] Continuation of Ser. No. 912,138, Sep. 23, 1986, abandoned, which is a continuation of Ser. No. 723,702, Apr. 15, 1985, abandoned, which is a continuation of Ser. No. 502,106, Jun. 8, 1983, abandoned.

[30] Foreign Application Priority Data

Jun. 15, 1982 [JP] Japan ..... 58-102653

[51] Int. Cl.[4] ..... F02M 7/00; F02D 5/02

[52] U.S. Cl. ..... 123/492; 123/491; 123/489

[58] Field of Search ..... 123/492, 495, 489, 440, 123/428, 339

[56] References Cited

U.S. PATENT DOCUMENTS

| | | | |
|---|---|---|---|
| 4,201,161 | 5/1980 | Sasayaura et al. | 123/489 |
| 4,348,727 | 9/1982 | Kobayashi et al. | 123/489 |
| 4,389,997 | 6/1983 | Nakanu et al. | 123/492 |
| 4,393,842 | 7/1983 | Oteuka et al. | 123/489 |
| 4,399,792 | 8/1983 | Oteuka et al. | 123/491 |
| 4,401,087 | 8/1983 | Ikaura | 123/492 |
| 4,413,602 | 11/1983 | Inoue et al. | 123/492 |

*Primary Examiner*—Raymond A. Nelli
*Attorney, Agent, or Firm*—Lyon & Lyon

[57] ABSTRACT

A fuel supply control method for controlling the quanity of fuel being supplied to an internal combustion engine, in a feedback manner responsive to the output of a means for detecting the concentration of an ingredient in exhaust gases emitted from the engine. When the engine is operating in a predetermined low speed operating region wherein the rotational speed of the engine is lower than a predetermined speed higher than the idling speed and the intake pipe absolute pressure is higher than a predetermined value higher than a value normally assumed at idle of the engine, the above feedback control is interrupted and the fuel quantity is increased by a predetermined amount so as to make the air/fuel ratio of a mixture being supplied to the engine richer than a theoretical mixture ratio. Preferably, the above predetermined speed and predetermined intake pipe absolute pressure applied for determination of the operating condition of the engine in the predetermined low speed operating region are each set to different values between when the operation of the engine enters the predetermined low speed operating region and when it leaves the same region.

4 Claims, 7 Drawing Sheets

CPU
503
ROM
507
RAM
508
DRIVING CIRCUITS
509
FUEL INJECTION DEVICE
6
510
ECU
A/D CONVERTER
506
5
MULTI-PLEXER
505
Me COUNTER
502
LEVEL SHIFTER UNIT
504
WAVEFORM SHAPER
501
θth SENSOR
4
PBA SENSOR
8
TA SENSOR
9
TW SENSOR
10
O2 SENSOR
15
PA SENSOR
16
BATTERY
17
Ne SENSOR
11

| FIG. 3A | FIG. 3B |
|---|---|

FUEL SUPPLY CONTROL METHOD FOR INTERNAL COMBUSTION ENGINES AT OPERATION IN A LOW SPEED REGION

This application is a continuation of Ser. No. 912,138, dated 09/23/86, now abandoned, which is a continuation of Ser. No. 723,702, dated 04/15/85, now abandoned, which is a continuation of Ser. No. 502,106, dated 06/08/83, now abandoned.

BACKGROUND OF THE INVENTION

This invention relates to a fuel supply control method for internal combustion engines, and more particularly to a method of this kind, which is adapted to control the fuel supply to the engine in accordance with a change in the operating condition of the engine when the operation of the engine shifts from an idling region to a certain low speed speed region, to thereby improve the driveability of the engine on such occasion.

A fuel supply control system adapted for use with an internal combustion engine, particularly a gasoline engine has been proposed e.g. by U.S. Pat. No. 3,483,851, which is adapted to determine the valve opening period of a fuel injection device for control of the fuel injection quantity, i.e. the air/fuel ratio of an air/fuel mixture being supplied to the engine, by first determining a basic value of the above valve opening period as a function of engine rpm and intake pipe absolute pressure and then adding to and/or multiplying same by constants and/or coefficients being functions of engine rpm, intake pipe absolute pressure, engine temperature, throttle valve opening, exhaust gas ingredient concentration (oxygen concentration), etc., by electronic computing means.

According to this proposed fuel supply control system, while the engine is operating in a normal operating condition, the air/fuel ratio of the mixture is controlled in closed loop mode wherein the value of a particular one of the above coefficients is varied in response to the output of a means arranged in the exhaust system of the engine for detecting the concentration of an ingredient in the exhaust gases so as to vary the valve opening period of the fuel injection device, whereas while the engine is operating in a particular operating region such as an idling region, a mixture-leaning region, a wide-open-throttle region and a decelerating region, the air/fuel ratio is controlled in open loop mode wherein the value of one of the coefficients corresponding to the particular operating region in which the engine is operating is set to a predetermined value so as to achieve a required air/fuel ratio best suited for the operation of the engine in the same particular operating region, threby improving the fuel consumption and driveability of the engine.

However, conventional fuel supply feedback control methods including the above proposed method are generally so arranged that when the operation of the engine leaves the idling region, the air/fuel ratio control is immediately switched over to closed loop mode from open loop mode so that the air/fuel ratio of the mixture being supplied to the engine is immediately controlled to the theoretical mixture ratio. However, when the vehicle is started to run while the engine is idling, usually the operation of the engine passes a certain low speed region adjacent the idling region, that is, a region wherein the rotational speed of the engine is lower than a value slightly higher than the idling speed and the intake pipe absolute pressure is higher than that in the idling region. If the air/fuel ratio is controlled in a feedback manner to the thereotical mixture ratio as in the conventional fuel supply control methods while the operation of the engine is passing this low speed region, there will occur a shortage in the output torque of the engine which is then in a heavily loaded state, thus resulting in a deterioration of the driveability of the engine.

SUMMARY OF THE INVENTION

It is the object of the invention to provide a fuel supply control method for an internal combustion engine, which is adapted to supply an increased quantity of fuel to the engine while the operation of the engine is passing a predetermined low speed region as a result of application of a heavy load on the engine operating in an idling region, such as starting to run the vehicle on which the engine is installed, to thereby improve the driveability and ensure stable operation of the engine.

The present invention provides a fuel supply control method for controlling the quantity of fuel being supplied to an internal combustion engine, in a feedback manner responsive to the output from a means for detecting the concentration of an ingredient in exhaust gases emitted from the engine. The method according to the invention is characterized by comprising the following steps: (1) determining whether or not the engine is operating in a predetermined low speed operating region wherein the rotational speed of the engine is lower than a predetermined value which is slightly higher than an idling speed thereof and the absolute pressure in an intake passage of the engine is higher than a predetermined value which is higher than a value normally assumed when the engine is idling; and (2) interrupting the above feedback control and increasing the quantity of fuel being supplied to the engine by a predetermined amount so that the resulting air/fuel mixture being supplied to the engine has an air/fuel ratio richer than a theoretical mixture ratio, when it is determined in the step (1) that the engine is operating in the above predetermined low speed operating region.

Preferably, the predetermined engine rotational speed and the predetermined intake passage absolute pressure, which are thus applied for determination of the operating condition of the engine in the above predetermined low speed operating region, are each set to different values between when the operation of the engine enters the predetermined low speed operating region and when it leaves the same operating region, to thereby ensure stable operaiton of the engine.

The above and other objects, features and advantages of the invention will be more apparent from the ensuring detailed description taken in conjunction with the accompanying drawings.

DETAILED DESCRIPTION

The present invention will now be described in detail with reference to the drawings.

Figure 1:
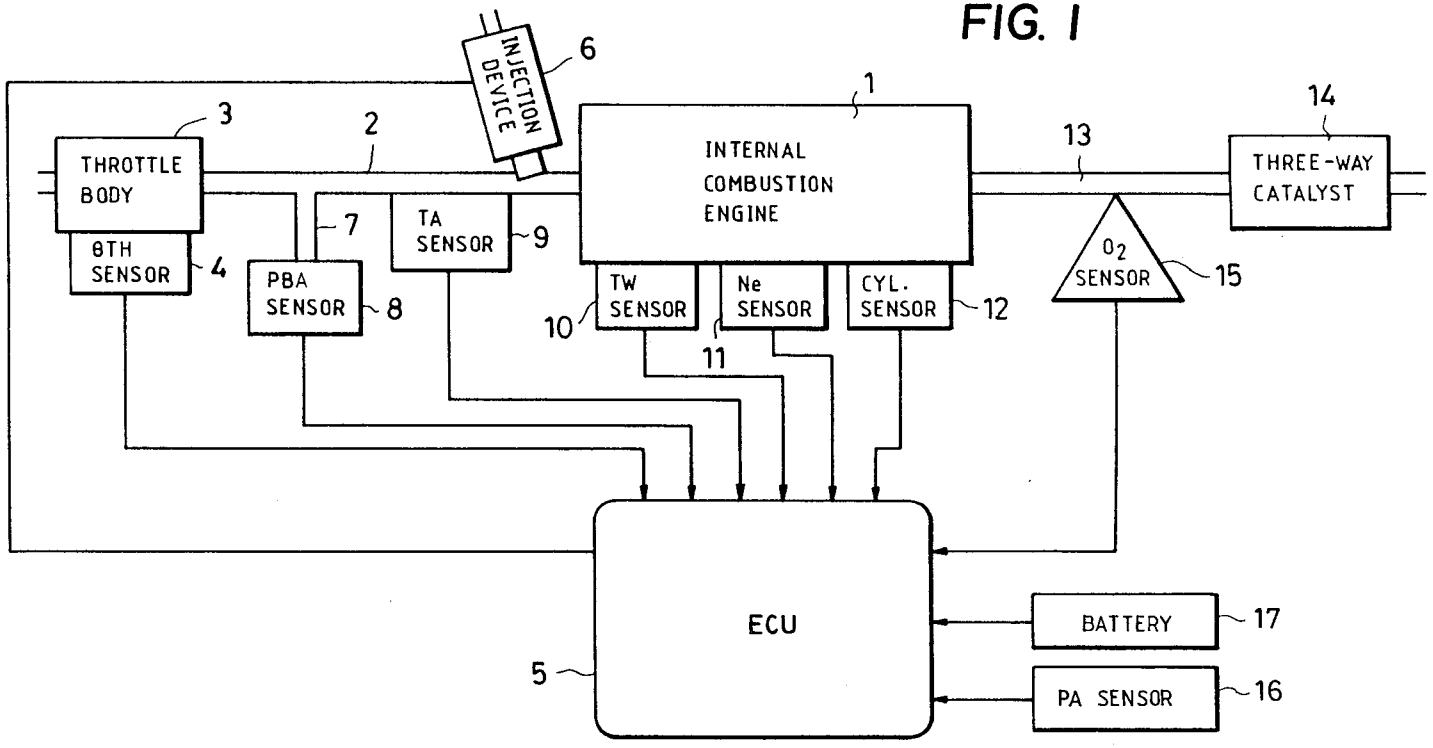
FIG. 1 is a block diagram illustrating the whole arrangement of a fuel supply control system to which is applicable the method according to the present invention.

Referring first to FIG. 1, there is illustrated the whole arrangement of a fuel supply control system for internal combustion engines, to which the method of the present invention is applicable. Reference numeral 1 designates an internal combustion engine which may be a four-cylinder type, for instance. This engine 1 has main combustion chambers which may be four in number and sub combustion chambers communicating with the main combustion chambers, none of which is shown. An intake pipe 2 is connected to the engine 1, which comprises a main intake pipe communicating with each main combustion chamber, and a sub intake pipe with each sub combustion chamber, respectively, neither of which is shown. Arranged across the intake pipe 2 is a throttle body 3 which accommodates a main throttle valve and a sub throttle valve mounted in the main intake pipe and the sub intake pipe, respectively, for synchronous operation. Neither of the two throttle valves is shown. A throttle valve opening sensor 4 is connected to the main throttle valve for detecting its valve opening and converting same into an electrical signal which is supplied to an electronic control unit (hereinafter called "ECU") 5.

A fuel injection device 6 as a fuel quantity metering means is arranged in the intake pipe 2 at a location between the engine 1 and the throttle body 3, which comprises main injectors and a subinjector, none of which is shown. The main injectors correspond in number to the engine cylinders and are each arranged in the main intake pipe at a location slightly upstream of an intake valve, not shown, of a corresponding engine cylinder, while the subinjector, which is single in number, is arranged in the sub intake pipe at a location slightly downstream of the sub throttle valve, for supplying fuel to all the engine cylinders. The fuel injection device is connected to a fuel pump, not shown. The main injectors and the subinjector of the fuel injection device 6 are electrically connected to the ECU 5 in a manner having their valve opening periods or fuel injection quantities controlled by signals supplied from the ECU 5.

On the other hand, an absolute pressure sensor 8 communicates through a conduit 7 with the interior of the main intake pipe of the throttle body 3 at a location immediately downstream of the main throttle valve. The absolute pressure sensor 8 is adapted to detect absolute pressure in the intake pipe 2 and applies an electrical signal indicative of detected absolute pressure to the ECU 5. An intake-air temperature sensor 9 is arranged in the intake pipe 2 at a location downstream of the absolute pressure sensor 8 and also electrically connected to the ECU 5 for supplying same with an electrical signal indicative of detected intake-air temperature.

An engine cooling water temperature sensor 10, which may be formed of a thermistor or the like, is mounted on the main body of the engine 1 in a manner embedded in the peripheral wall of an engine cylinder having its interior filled with cooling water, an electrical output signal of which is supplied to the ECU 5.

An engine rpm sensor (hereinafter called "Ne sensor") 11 and a cylinder-discriminating sensor 12 are arranged in facing relation to a camshaft, not shown, of the engine 1 or a crankshaft of same, not shown. The former 11 is adapted to generate one pulse at a particular crank angle each time the engine crankshaft rotates through 180 degrees, i.e., upon generation of each pulse of the top-dead-center position (TDC) signal, while the latter is adapted to generate one pulse at a particular crank angle of a particular engine cylinder. The above pulses generated by the sensors 11, 12 are supplied to the ECU 5.

A three-way catalyst 14 is arranged in an exhaust pipe 13 extending from the main body of the engine 1 for purifying ingredients HC, CO and NOx contained in the exhaust gases. An $O_2$ sensor 15 is inserted in the exhaust pipe 13 at a location upstream of the three-way catalyst 14 for detecting the concentration of oxygen in the exhaust gases and supplying an electrical signal indicative of a detected concentration value to the ECU 5.

Further connected to the ECU 5 are a sensor 16 for detecting atmospheric pressure for supplying the ECU 5 with an electrical signal indicative of detected atmospheric pressure and a battery 17 for supplying the ECU 5 with electric power.

The ECU 5 operates on the various engine operation parameter signals stated above, inputted thereto to determine the valve opening periods TOUTM and TOUTS for the main injectors and the subinjector which are driven in synchronism with generation of pulses of the TDC signal, by the use of the following equations (1) or (1') and (2):

$$TOUTM = TiM \times K_1 + K_2 \quad (1)$$

or $$TOUTM = TiM \times K1' + K2', \quad (1')$$

$$TOUTS = TiS \times K_3 + K_4 \quad (2)$$

where TiM and TiS represent the basic fuel injection periods of the main injectors and the subinjector, each of which is read from a storage means within the ECU 5, as a function of the intake pipe absolute pressure PBA and the engine rpm Ne, and $K_1$, K1' and $K_3$, and $K_2$, K2', and $K_4$ represent correction coefficients and correction values, respectively, the values of which are calculated on the basis of engine operation parameter signals from the aforementioned various sensors so as to achieve optimum operating characteristics of the engine such as fuel consumption and accelerability.

The correction coefficient $K_1$ is determined from the following equation in the form of a product of a mixture-enriching coefficient KDR applicable at operation of the engine in a predetermined low speed operating region as described later, an "$O_2$ sensor output-dependent feedback control" correction coefficietn $KO_2$, an intake air temperature-dependent correction coefficient KTA, an engine cooling water temperature-dependent correction coefficient KTW, an after-fuel cut fuel quantity increasing coefficient KAFC, a mixture-enriching coefficient KWOT applicable at wide-open-throttle, and a mixture-leaning coefficient KLS applible at operation of the engine in a predetermined mixture-leaning region:

$$K_1 = KDR \times KO_2 \times KTA \times KTW \times KAST \times KAFC \times KWOT \times KLS \quad (3)$$

The correction value $K_2$ is determined from the following equation in the form of the sum of a product of a fuel quantity increasing value TACC applicable at acceleration of the engine, the above-mentioned coefficient KTA, a water temperature-dependent fuel quantity increasing coefficient KTWT applicable at acceleration and post-acceleration of the engine, and a fuel quantity increasing coefficient KTAST applicable immediately after the start of the engine, and a battery voltage-dependent correction value TV and a correction coefficient ΔTV whose value is set in dependence on the operating characteristics of individual injectors:

$$K_2 = TACC \times (KTA \times KTWT \times KTAST) + (TV + \Delta TV) \quad (4)$$

When the engine is operating in the aforementioned predetermined low speed operating region, the correction coefficient KDR, the value of which is calculated as hereinafter described, is applied to the equation (1) so as to increase the quantity of fuel being supplied to the engine.

Alternatively of the equation (1) may be used the equation (1'). In this equation (1'), the values of the coefficient K1' and the value K2' are calculated by the use of the following equations:

$$K1' = KO_2 \times KTA \times KTW \times KTAST \times KAFC \times KWOT \times KLS \quad (5)$$

$$K2' = TACC \times (KTA \times KTWT \times KTAST) + TV + \Delta TV) + TDR \quad (6)$$

where TDR is a mixture-enriching value applicable at operation of the engine in the aforementioned predetermined low speed operating region.

The ECU 5 calculates the fuel injection periods TOUTM, TOUTS for the injectors, by the use of the equations (1) and (2) or (1') and (2), and generates driving signals for causing the main injectors and the subinjector to open with duty factors corresponding to the calculated fuel injection periods.

Figure 2:
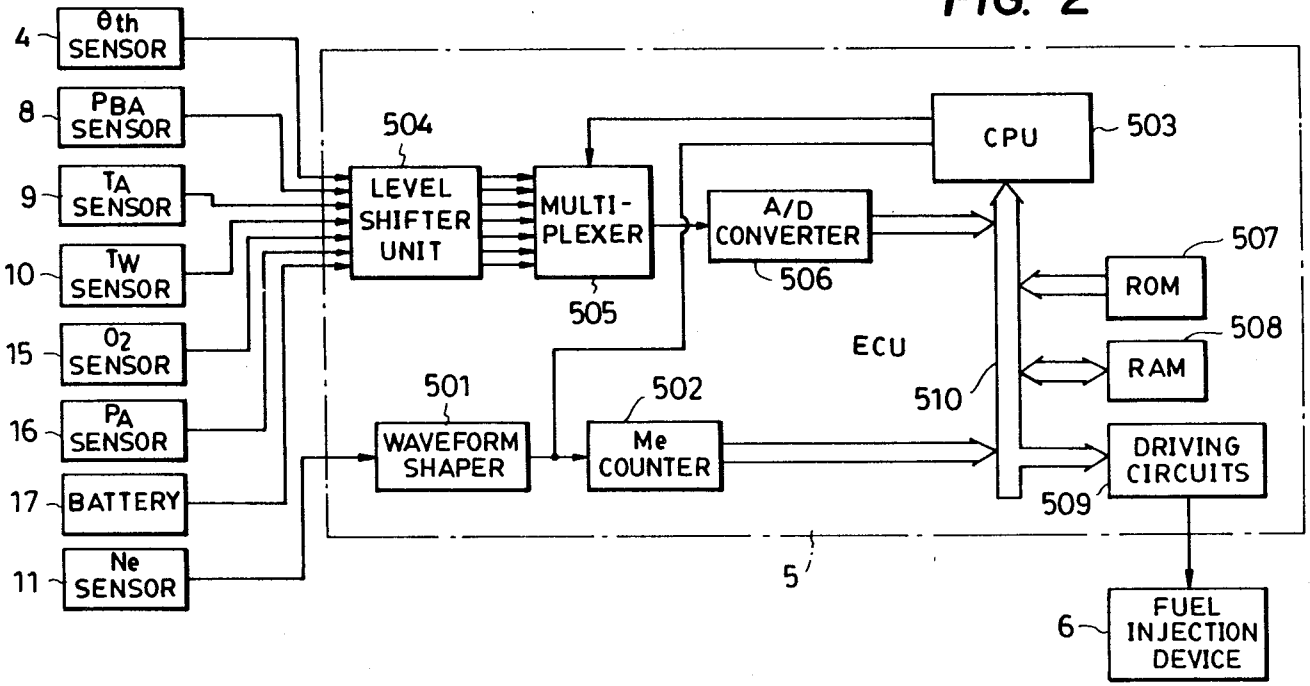
FIG. 2 is a circuit diagram showing an electrical circuit within the electronic control unit (ECU) 5 in FIG. 1.

FIG. 2 is a block diagram showing an electrical circuit within the ECU 5 in FIG. 1. The engine rpm signal from the Ne sensor 11 in FIG. 1 is applied to a waveform shaper 501, wherein it has its pulse waveform shaped, and supplied to an Me value counter 502 as well as to a central processing unit (hereinafter called "CPU") 503 as a TDC signal. The Me value counter 502 counts the interval of time between a preceding pulse of the engine rpm signal generated at a predetermined crank angle of the engine and a present pulse of the same signal generated at the predetermined crank angle, inputted thereto from the Ne sensor 11, and therefore its counted value Me corresponds to the reciprocal of the actual engine rpm Ne. The Me value counter 502 supplies the counted value Me to the CPU 503 via a data bus 510.

The respective output signals from the throttle valve opening sensor 4, the absolute pressure sensor 8, the intake air temperature sensor 9, the Ne sensor 11, the $O_2$ sensor 15, the atmospheric pressure sensor 16 and the battery 17, all appearing in FIG. 1, have their voltage levels shifted to a predetermined voltage level by a level shifter unit 504 and applied successively to an analog-to-digital converter (hereinafter called "A/D converter") 506 through a multiplexer 505 which operates on a command signal from the CPU 503. The A/D converter 506 successively converts the above signals into digital signals and supplies them to the CPU 503 via the data bus 510.

The CPU 503 is also connected to a read-only memory (hereinafter called "ROM") 507, a random access memory (hereinafter called "RAM") 508, and driving circuits 509, through the data bus 510. The ROM 507 stores a control program executed within the CPU 503, data of basic values TiM, TiS of fuel injection periods for the main injectors and the sub injector, data of the correction coefficients and correction values, etc. while the RAM 508 temporarily stores the resultant values of various calculations from the CPU 503. The CPU 503 executes the control program stored in the ROM 507 in synchronism with generation of the TDC signal to read values of the above coefficients and correction values corresponding to the output signals from the above various sensors, from the ROM 507, and calculate the valve opening periods TOUTM, TOUTS for the main injectors and the subinjector by applying to the aforementioned equations, the read values of the aforementioned coefficients and correction values, and supply the calculated TOUTM and TOUTS values to the driving circuits 509 via the data bus 510. The driving circuits 509 supply driving signals corresponding to the above TOUTM and TOUTS values to the main injectors and the subinjector to energize same.

Figures 3, 3B:
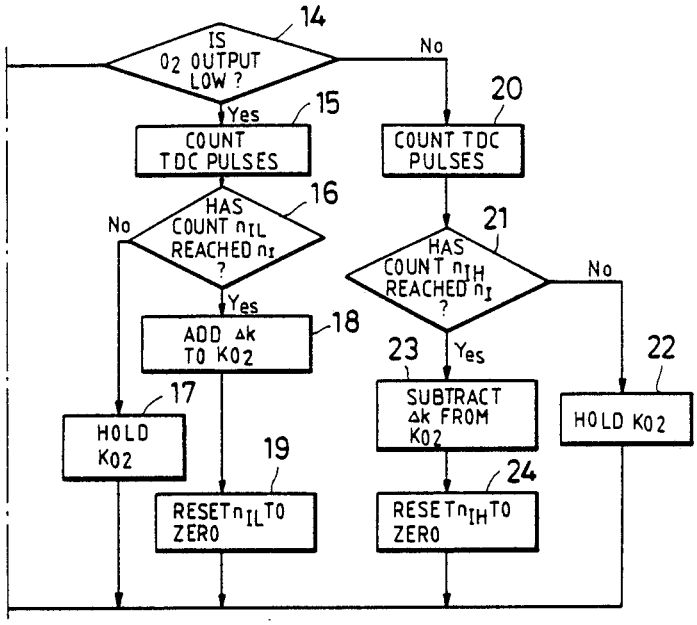
FIGS. 3A, 3B and 3 are a flow chart showing a subroutine for calculating an $O_2$ sensor output-dependent correction coefficient $KO_2$.
Figure 3A:
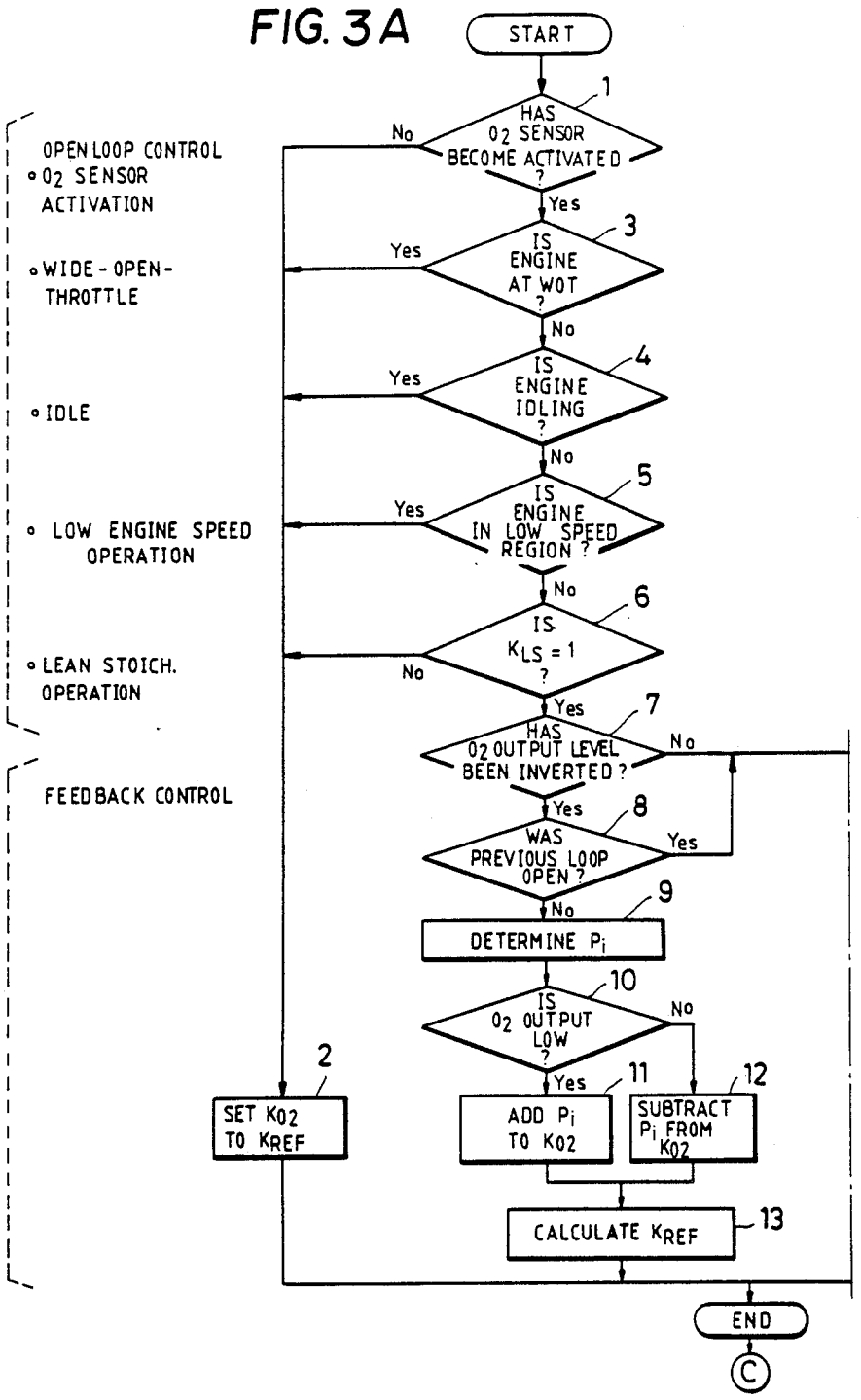

FIG. 3 shows a flow chart of a subroutine for calculating the $O_2$ sensor output-dependent correction coefficient $KO_2$, and determining the particular operating regions of the engine.

Figure 4:
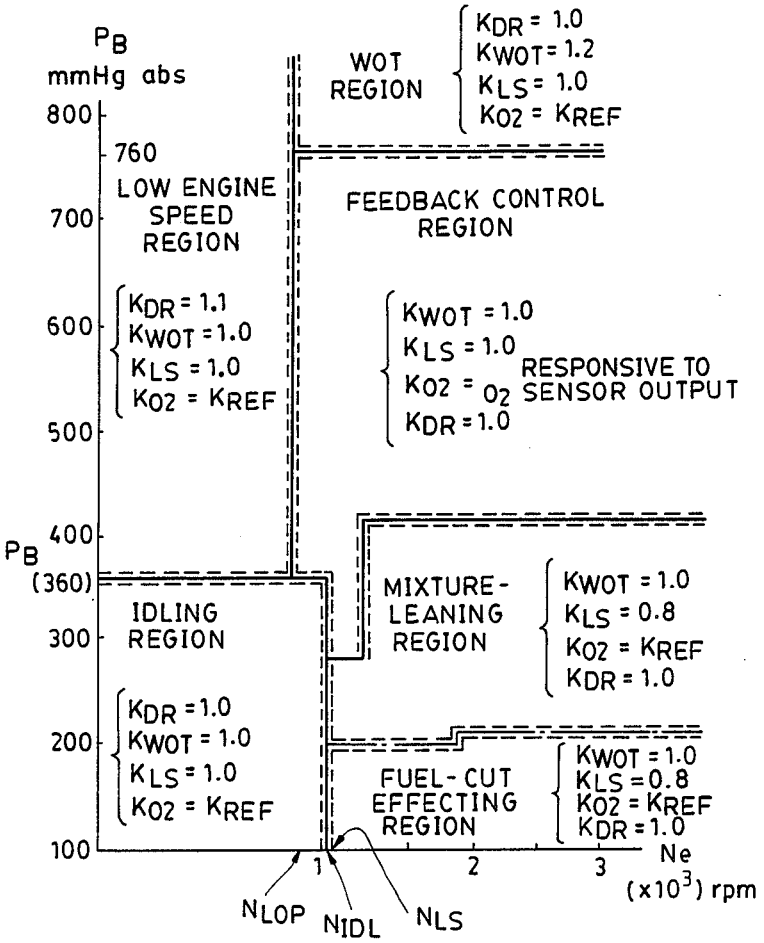
FIG. 4 is a graph showing a manner of applying correction coefficients to various operating regions of the engine.

First, a determination is made as to whether or not the $O_2$ sensor has become activated, at the step 1. More specifically, by utilizing the internal resistance of the $O_2$ sensor, it is detected whether or not the output voltage of the $O_2$ sensor has dropped to an initial activation point VX (e.g. 0.6 volt). Upon the point VX being reached, an activation-indicative signal is generated which actuates an associated activation delay timer to start counting a predetermined period of time (e.g. 60 seconds). At the same time, it is determined whether or not the water temperature-dependent fuel quantity increasing coefficient KTW and the after-start fuel quantity increasing coefficient KAST both are equal to 1. If all the above conditions are found to be fulfilled, it is then determined that the $O_2$ sensor has been activated. If the activation of the $O_2$ sensor is negated at the step 1, the value of the correction coefficient $KO_2$ is set to a mean value KREF, referred to later, which has been obtained in the last feedback control operation based on the $O_2$ sensor output, at the step 2. When the $O_2$ sensor is found to be activated, a determination is made as to whether or not the throttle valve is fully opened (wide-open-throttle), at the step 3. FIG. 4 is a graph showing various particular operating regions of the engine which are each determined by engine rpm Ne and intake pipe absolute pressure PBA. The above determination as to whether or not the throttle valve is fully opened is made on the basis of throttle valve opening and intake pipe absolute pressure. If the answer to the question of the step 3 is affirmative, the value of $KO_2$ is also set to the above mean value KREF. If the throttle valve is not fully opened, whether or not the engine is at idle is determined at the step 4. To be concrete, if the engine rpm Ne is smaller than a predetermined value NIDL (e.g. 1000 rpm) and the absolute pressure PBA is lower than a predetermined value PBAIDL (e.g. 360 mmHg), the engine is judged to be idling, and then the above step 2 is executed to set the $KO_2$ value to the value KREF. If the engine is not found to be idling, whether or not the engine is operating in the aforementioned predetermined low speed operating region is determined at the step 5. This predetermined low speed operating region is a region which the operation of the engine normally passes while it is shifting from the idling region to a higher speed region. More specifically, the predetermined low speed operating region is defined as a region where the rotational speed Ne of the engine is lower than a predetermined value of rpm NLOP (e.g. 900 rpm) which is slightly higher than an idling speed (e.g. 650–700 rpm) normally assumed by the engine when the throttle valve is in its idling position and at the same time the intake pipe absolute pressure PBA is higher than a predetermined value which is slightly higher than a value (e.g. 260 mmHg) normally prevailing in the intake passage 2 of the engine when the throttle valve is in its idling position, that is, the aforementioned predetermined upper limit PBAIDL (=360 mmHg) of absolute pressure defining the idling region.

If the engine is determined to be operating in the above predetermined low speed operating region at the step 5, that is, if the engine speed Ne is lower than the predetermined value of rpm NLOP and the intake pipe absolute pressure PBA is higher than the predetermined value PBAIDL (360 mmHg), the step 2 is executed to set the value of the coefficient $KO_2$ to the mean value KREF.

On the other hand, if it is determined at the step 5 that the engine is not operating in the predetermined low speed operating region, it is then determined at the step 6 whether or not the aforementioned mixture-leaning coefficient KLS assumes a value of 1.0. The value of the mixture-leaning coefficient KLS is set to 0.8 while the engine is operating in the aforementioned predetermined mixture-leaning region or in a predetermined fuel cut effecting region, and it is set to 1.0 while the engine is operating in any other operating region. Therefore, whether or not the engine is operating in such predetermined mixture-leaning region or in such predetermined fuel cut effecting region can be determined by determining whether or not the value of the mixture-leaning coefficient KLS is 1.0. If the answer to the question of the step 6 is no, the value of the correction coefficient $KO_2$ is set to the mean value KREF, at the step 2, while if it is yes, the program then proceeds to execution of the feedback control of the fuel supply to the engine in a manner described later.

Preferably, the predetermined values of intake pipe absolute pressure and engine rpm for determination of the operating regions of the engine, shown in FIG. 4, such as the predetermined low speed operating region, are provided with hysteresis margins as indicated by the two parallel dotted lines in FIG. 4, so as to achieve stable operation of the engine. For example, the predetermined intake pipe absolute pressure PBAIDL (e.g. 360 mmHg) for determination of whether or not the engine has shifted between the idling region and the predetermined low speed operating region is provided with a hysteresis margin of ±5 mmHg with respect to a basic value of 360 mmHg. That is, the predetermined value PBAIDL is set to 365 mmHg to determine whether or not the engine has shifted from the idling region to the predetermined low speed operating region, whereas it is set to 355 mmHg to determine whether or not the engine has shifted from the latter region to the former region. Also, the predetermined engine rpm value NLOP for determination of shifting of the operating condition of the engine between the feedback control region and the predetermined low speed operating region is provided with a hysteresis margin of ±25 mmHg, so that it is set to 925 rpm and 875 rpm, respectively, to determine shifting of the operating condition of the engine from the predetermiend low speed operating region to the feedback control region and vice versa.

Figure 5:
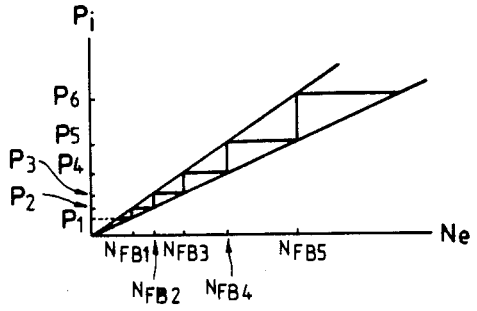
FIG. 5 is a view showing an Ne-Pi table for determining a correction value Pi for correcting the correction coefficient $K0_2$.

Referring again to FIG. 3, the manner of calculating the value of the correction coefficient $KO_2$ during the feedback control operation of the engine will now be explained. It is first determined whether or not there has occurred an inversion in the output level of the $O_2$ sensor, at the step 7. If the answer is affirmative, whether or not the previous loop was an open loop is determined at the step 8. If it is determined at the step 8 that the previous loop was not an open loop, the air/fuel ratio of the mixture is controlled by proportional term control (P-term control). More specifically, referring to FIG. 5 showing an Ne-Pi table for determining a correction amount Pi by which the correction coefficient $KO_2$ is corrected, five different predetermined Ne values $NFB_{1-5}$ are provided which fall within a range from 1500 rpm to 3500 rpm, while six different predetermined Pi values $P_{1-6}$ are provided in relation to the above Ne values, by way of example. Thus, the value of the correction amount Pi is determined from the engine rpm Ne at the step 9, which is added to or subtracted from the coefficient $KO_2$ upon each inversion of the output level of the $O_2$ sensor. Then, whether or not the output level of the $O_2$ sensor is low is determined at the step 10. If the answer is yes, the Pi value obtained from the table of FIG. 5 is added to the value of the coefficient $KO_2$, at the step 11, while if the answer is no, the former is subtracted from the latter at the step 12. Then, a mean value KREF is calculated from the value of $KO_2$ thus obtained, at the step 13. Calculation of the mean value KREF can be made by the use of the following equation:

$$KREF = \frac{CREF}{A} \times KO_2p + \frac{A - CREF}{A} \times KREF \qquad (7)$$

where $KO_2p$ represent a value of $KO_2$ obtained immediately before or immediately after a proportional term (P-term) control action, A a constant (e.g. 256), CREF a variable which is experimentally determined for each of these regions and set within a range from 1 to A-1, and KREF' a mean value of values $K0_2$ obtained from the start of the first operation of an associated control circuit to the last proportional term control action inclusive.

Since the value of the variable CREF determines the ratio of the value $KO_2p$ obtained at each P-term control action, to the value KREF, an optimum value KREF can be obtained by setting the value CREF to a suitable value within the range from 'to A-1 depending upon the specifications of an air/fuel ratio control system, an engine, etc. to which the invention is applied.

Figure 6:
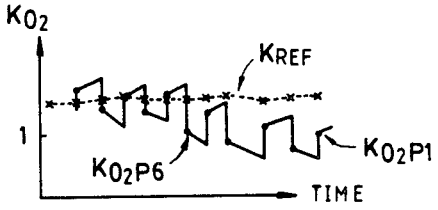
FIG. 6 is a graph showing a manner of detecting values of correction coefficients $KO_2p$ during proportional term control.

As noted above, the value KREF is calculated on the basis of a value $KO_2p$ obtained immediately before or immediately after each P-term control action. This is because the air/fuel ratio of the mixture being supplied to the engine occurring immediately before or immediately after a P-term control action, that is, at an instant of inversion of the output level of the $O_2$ sensor shows a value most close to the theoretical mixture ratio (14.7). Thus, a mean value of $KO_2$ values can be obtained which are each calculated at an instant when the actual air/fuel ratio of the mixture shows a value most close to the theoretical mixture ratio, thus making it possible to calculate a value KREF most appropriate to the actual operating condition of the engine. FIG. 6 is a graph showing a manner of detecting (calculating) the value $KO_2p$ at an instant immediately after each P-term control action. In FIG. 6, the mark. indicates a value $KO_2p$ detected immediately after a P-term control action, and $KO_2p1$ is an up-to-date value detected at the present time, while $KO_2P6$ is a value detected immediately after a P-term control action which is a sixth action from the present time.

Figure 7:
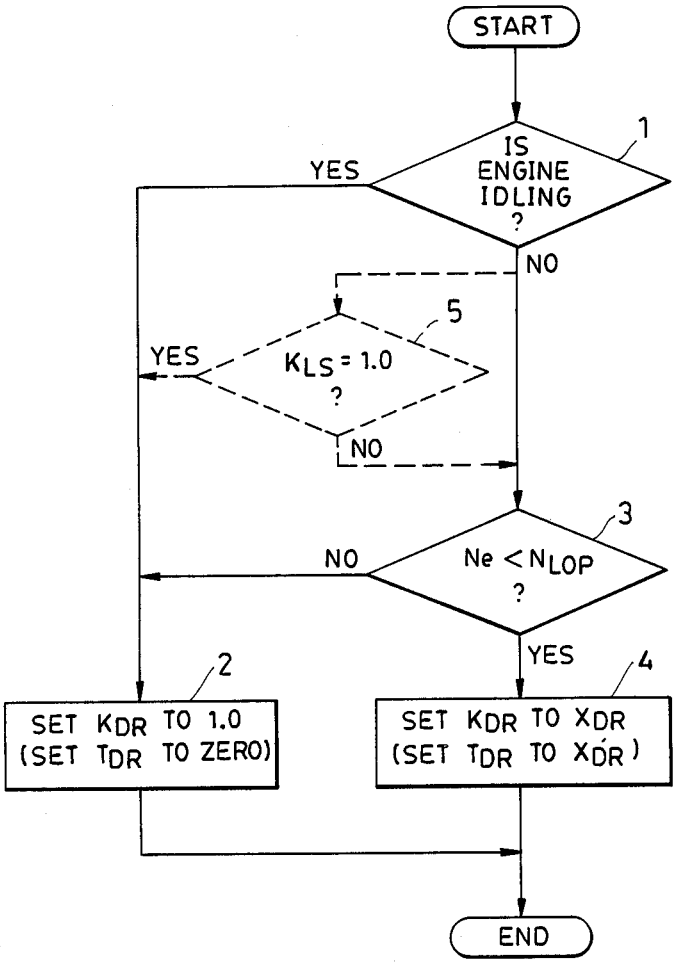
FIG. 7 is a flow chart of a subroutine for calculating the value of a fuel quantity-increasing coefficient KDR or a fuel quantity-increasing value TDR.

FIG. 7 shows a flow chart of a subroutine for calculating the values of the mixture-enriching correction coefficient KDR and the mixture-enriching correction value TDR. First, it is determined whether or not the engine is idling or operating in the idling region, at the step 1. If the answer is yes, that is, if the engine speed Ne is lower than the predetermined value of rpm NIDL (e.g. 1,000 rpm) and the intake pipe absolute pressure PBA is smaller than the predetermined value PBAIDL (e.g. 360 mmHg), the program proceeds to the step 2, wherein the value of the mixture-enriching correction coefficient KDR is set to 1.0. If the answer to the question of the step 1 is no, the program proceeds to the step 3, wherein it is determined whether or not the engine speed Ne is lower than the predetermined value of rpm NLOP. If the answer is no, the step 2 is executed to set the value of the correction coefficient KDR to 1.0. On the other hand, if the answer is yes, the value of the same correction coefficient KDR is set to a predetermined value XDR, at the step 4. This predetermined value XDR is set to 1.1 for instance. Thus, the quantity of fuel being supplied to the engine is increased so as to set the air/fuel ratio of the mixture to a value richer than the theoretical mixture ratio (14.7). Therefore, it is possible to avoid a shortage in the output torque of the engine while the engine operation is passing the predetermined low speed operating region in the event that the engine becomes heavily loaded while it is in an idling state, for instance, when the vehicle is started to run, thereby improving the driveability.

Alternatively of the mixture-enriching correction coefficient KDR may be applied the aforementioned mixture-enriching correction value TDR in such a manner that at the above step 2 the value of the correction value TDR is set to 0, while at the step 4 the value of the same value TDR is set to a suitable predetermined value XDR'.

The predetermined low speed operating region of the engine to which the mixture-enriching correction coefficient KDR or the mixture-enriching correction value TDR is applied is not limited to the one according to the present embodiment as defined by the predetermined engine rpm value NLOP and the predetermined intake pipe absolute pressure PBAIDL as shown in FIG. 4, but it may extend to part of the mixture-leaning region shown in FIG. 4, for example. In order to determine whether or not the engine is operating in this alternative predetermined low speed operating region, a further step 5 is added as indicated by the broken line in FIG. 7, which is interposed between the step 1 and the step 3. That is, if it is determined at the step 1 that the engine is not operating in the idling region, the program proceeds to the step 5, wherein it is determined whether or not the value of the mixture-leaning coefficient KLS is 1.0. If the answer is yes, the value of the mixture-enriching coefficient KDR is set to 1.0 or the value of the mixture-enriching correction value TDR is set to 0, whereas if the answer is no, the determination of the step 3 is executed.

The value of the mixture-enriching correction coefficient KDR or the value of the mixture-enriching correction value TDR thus obtained is applied to the aforegiven equation (1) or (1'), together with the other correction coefficients KWOT, KLS and the mean value KREF for calculation of the fuel injection periods of the fuel injection device, while the engine is operating in the predetermined low speed operating region.

Although in the foregoing embodiment, the fuel quantity metering device is formed by the fuel injection device 6, a carburetor may be employed as such fuel quantity metering device, instead.

Although in the foregoing embodiment the fuel supply quantity is controlled by varying the duration of application of a driving signal pulse to each injector, a fuel quantity metering device may alternatively be employed which is adapted to control the fuel supply quantity by varying the fuel pressure to be applied on the injector.

What is claimed is:

1. A method of controlling the air/fuel ratio of an air/fuel mixture to be supplied to an internal combustion engine having a sensor arranged in an exhaust system of the engine for detecting the concentration of an ingredient in exhaust gases emitted from the engine, wherein a basic value (TiM), based on which is controlled the air/fuel ratio of an air/fuel mixture to be supplied to the engine is determined as a function of the rotational speed (Ne) of the engine and load (PB) on the engine, an output value ($VO_2$) of said sensor is compared with a predetermined reference value (VREF) with reference to which is determined the air/fuel ratio, to thereby adjust a correction coefficient ($KO_2$) on the basis of the result of said comparison, an air-fuel control value (TOUT) is calculated on the basis of the determined basic value (TiM) and the adjusted correction coefficient ($KO_2$), and feedback control of the air/fuel ratio of the air/fuel mixture is carried out in accordance with the calculated air/fuel control value (TOUT), which is characterized by comprising the steps of:

(1) determining which of the following conditions the engine is operating in, in response to the engine speed (Ne) and the engine load (PB):
  (a) idling,
  (b) standing start of a vehicle on which the engine is installed in transition of the engine operation from the idling, in which the rate of increase in the engine load is greater than the rate of increase in the engine speed, and
  (c) operation in feedback control mode in which the feedback control of the air/fuel ratio is carried out in response to the output value of said sensor for detecting the concentration of an ingredient in exhaust gases, and (2) multiplying said basic value (TiM) by a mixture-enriching correction coefficient (KDR) to thereby enrich the air/fuel mixture to be supplied to the engine, when it is detected that the engine is in said condition (b), while prohibiting said feedback control of the air/fuel ratio from being carried out, by setting said correction coefficient ($KO_2$) to such a value as does not cause any correction of the air/fuel ratio.

2. A method as claimed in claim 1, wherein said condition (b) of standing start corresponds to an operating region of said engine adjacent an idling region of said engine, and in which the rotational speed of the engine is lower than a predetermined value which is slightly higher than an idling speed of the engine operating in said idling region, said predetermined value being slightly lower than an upper limit of the rotational speed defining the idling region, and the absolute pressure in an intake passage of the engine is higher than a predetermined minimum value normally assumed when a load is applied on the engine operating in the idling region, said predetermined minimum value being equal to an upper limit of the absolute pressure defining the idling region.

3. A method as claimed in claim 2, wherein said predetermined value of the rotational speed of the engine applied in said step (1) for determination of the operating condition of the engine in said predetermined low speed operating region is set to different values between when the operation of the engine enters said predetermined low speed operating region and when it leaves the same operating region.

4. A method as claimed in claim 2, wherein said predetermined value of the absolute pressure in said intake passage applied in said step (1) for determination of the operating condition of the engine in said predetermined low speed operating region is set to different values between when the operation of the engine enters said predetermined low speed operating region and when it leaves the same operating region.

* * * * *